US005257748A

United States Patent [19]

Morizzo

[11] Patent Number: 5,257,748

[45] Date of Patent: Nov. 2, 1993

[54] SHEET WINDING APPARATUS

[75] Inventor: Nicholas L. Morizzo, New Port Richey, Fla.

[73] Assignee: Krantz America, Inc., Charlotte, N.C.

[21] Appl. No.: 711,634

[22] Filed: Jun. 6, 1991

Related U.S. Application Data

[63] Continuation-in-part of Ser. No. 413,478, Sep. 27, 1989, Pat. No. 5,022,597.

[51] Int. Cl.[5] ..... B65H 19/30; B65H 18/22

[52] U.S. Cl. ..... 242/56 R; 242/66

[58] Field of Search ..... 242/56 R, 65, 66

[56] References Cited

U.S. PATENT DOCUMENTS

| | | | |
|---|---|---|---|
| 2,830,775 | 4/1958 | Kiesel | 242/66 X |
| 3,450,364 | 6/1969 | Marsh et al. | 242/66 |
| 3,599,889 | 8/1971 | Pfeiffer | 242/66 |
| 3,687,388 | 8/1972 | Pfeiffer | 242/66 X |
| 3,721,396 | 3/1973 | Morizzo | 242/56 R |
| 3,817,467 | 6/1974 | Dambroth | 242/56 R |
| 3,918,654 | 11/1975 | Okubo et al. | 242/66 X |
| 3,944,149 | 3/1976 | Frezza | 242/56 R |
| 4,146,190 | 3/1979 | Bond et al | 242/66 X |
| 4,304,368 | 12/1981 | Bartmann | 242/56 R |
| 4,345,722 | 8/1982 | Kuhn | 242/56 R |
| 4,436,251 | 3/1984 | Deyesso et al. | 242/56 R |
| 4,456,190 | 6/1984 | Karttunen et al. | 242/56 R |
| 4,489,900 | 12/1984 | Morizzo | 242/56 R |
| 4,516,735 | 5/1985 | Snygg | 242/56 R |
| 4,549,700 | 10/1985 | Ganseuer | 242/56 R |
| 4,601,441 | 7/1986 | Oinonen et al. | 242/56 R |
| 4,618,105 | 10/1986 | Kuhn | 242/56 R |
| 4,715,552 | 12/1987 | Matsumoto | 242/56 R X |
| 4,746,076 | 5/1988 | Tomma et al. | 242/56 R |
| 4,842,209 | 6/1989 | Saukkonen | 242/56 R |
| 4,883,233 | 11/1989 | Saukkonen et al. | 242/66 |
| 4,909,452 | 3/1990 | Hertel et al. | 242/56 R |
| 4,921,183 | 5/1990 | Saukkonen et al. | 242/66 |
| 4,962,897 | 10/1990 | Bradley | 242/66 X |
| 5,063,970 | 11/1991 | Tanaka et al. | 242/66 X |

*Primary Examiner*—Daniel P. Stodola
*Assistant Examiner*—John P. Darling
*Attorney, Agent, or Firm*—Shefte, Pinckney & Sawyer

[57] ABSTRACT

A batcher-type sheet material winding apparatus includes a pair of driven winding rollers in spaced axially parallel relation for supporting a winding core peripherally between the rollers. A rotating arm assembly positioned above the winding core discharges the fully wound winding core via a discharge roller on a supporting arm of the assembly. One winding roller is driven at a constant peripheral speed equal to the traveling speed of the material, the other roller being driven at either a slightly greater speed to achieve dense material compaction or at a gradually decreasing speed to achieve uniform material winding density. A stationary cutting blade and a rotating cutting blade mounted to the arm assembly shear the material upon discharge from the winding rollers. An air discharge nozzle arrangement wraps and tucks the leading edge of material following a cut about a replacement core for resumption of winding operation. A microprocessor automatically controls all apparatus operations.

18 Claims, 12 Drawing Sheets

SHEET WINDING APPARATUS

CROSS REFERENCE TO RELATED APPLICATION

This is a continuation-in-part of U.S. patent application Ser. No. 413,478, filed Sep. 27, 1989, entitled SHEET WINDING APPARATUS, now U.S. Pat. No. 5,022,597.

BACKGROUND OF THE INVENTION

The present invention relates generally to apparatus for winding continuous-length sheet material, such as textile fabrics, onto a supporting core and, more particularly, to winding apparatus of the type commonly referred to as batchers adapted for cutting the sheet material widthwise once a desired quantity of the sheet material has been wound on the core, whereupon the fully-wound core is removed and the winding process is continued with a replacement core.

A batcher-type winding apparatus of the aforementioned type which has been well received commercially is disclosed in U.S. Pat. No. 3,721,396. In such apparatus, a tubular core is supported by an internal mandrel in peripheral frictional engagement with a driving roller for driven rotation of the core to progressively wind thereabout a traveling sheet of textile fabric or other sheet material fed to the nip between the core and the driving roller. A second driving roller is provided at a lateral spacing from the first-mentioned driving roller and is similarly operable for peripheral driving of the core. The core-supporting mandrel is mounted on an extensible piston of a piston-and-cylinder assembly for displacement of the core and the sheet material wound thereabout from driven contact with the first roller into driver contact with the second roller once the windings of the sheet material about the core have been built to a predetermined diameter, following which the winding operation is continued under the driving operation of the second driving roller. When the core is displaced into driven contact with the second driving roller, the sheet of material is trained to travel through a shear-cutting assembly disposed intermediate the first and second driving rollers. The shear-cutting assembly includes a first cutting blade stationarily mounted to contact one face of the traveling sheet material and a second cutting blade mounted at the free end of a rotatable arm movable through a cutting arc at the opposite face of the fabric into and out of cutting engagement with the first blade to shear-cut the material transversely across its width. This shear-cutting operation advantageously achieves a substantially straight cut without risk of ripping or tearing the sheet material and without requiring a stoppage or slowing of the traveling movement of the sheet material and further is capable of reliably cutting a wide variety of sheet materials many of which may be difficult to sever by other cutting means.

The commercial embodiment of the batcher-type winding apparatus of U.S. Pat. No. 3,721,396 has changed over the years since issuance of such patent. In the current commercial embodiment of this apparatus, a single core-winding station is provided whereat a pair of driving rollers are arranged in relatively closely spaced axially parallel relation for receiving the mandrel-mounted core between the driving rollers in peripheral contact with each thereof. In addition, the rotatable cutter arm on which the movable cutting blade is supported is of an L-shaped configuration to extend in a cantilevered fashion from its rotational axis to allow winding build-up on the core to the fullest desired wound diameter without need to displace the core from a first winding station to a second laterally spaced winding station. The pivoting cutter arm is further designed to engage the wound core during cutting rotation in advance of cutting engagement between the cutting blades to discharge the wound core from the driving rollers and position the trailing length of unwound fabric on the stationary cutting blade in preparation for the subsequent cutting operation.

SUMMARY OF THE INVENTION

The present invention provides an improvement of the above-described batcher-type winding apparatus. Briefly summarized, the apparatus of the present invention includes a pair of winding rollers rotatably mounted in spaced axially parallel relation by an associated arrangement capable of moving one of the winding rollers relative to the other winding roller between an operative winding position wherein the one winding roller is disposed relatively horizontally adjacent the other winding roller for cooperatively supporting the core peripherally between the winding rollers and a discharge position wherein the one winding roller is disposed at a sufficient vertical elevation relative to the other winding roller for ejecting the core from the winding rollers. At least one of the winding rollers is rotatably driven for driving rotation of the core to progressively wind the traveling sheet of material about the core. An arrangement is provided for receiving and supporting the core at a spacing from the winding rollers upon ejection of the core and a shear-cutting mechanism is operable following ejection of the core to cut the sheet of material transversely across its length at a location intermediate the winding rollers and the receiving and supporting arrangement.

In the preferred embodiment of the present winding apparatus, the winding roller drive is arranged for driving each of the winding rollers at individually variable speeds so that the winding compaction of the sheet of material on the core may be controlled. Preferably, one of the winding rollers is driven at a substantially constant peripheral speed substantially the same as the traveling speed of the sheet of material while the other winding roller is driven at a different peripheral speed. For example, in the winding of delicate or pile fabrics, the latter winding roller may be driven at a gradually varying peripheral speed as the sheet of material is wound on the core to achieve a generally uniform density of the windings of the sheet of material on the core. On the other hand, the latter winding roller may alternatively be driven at a substantially constant peripheral speed slightly greater than the peripheral speed of the first winding roller to wind the sheet of material in densely compacted windings. A sensing arrangement may be utilized to monitor fluctuations in the tension of the sheet of material and may be associated with the winding roller drive to vary its driven speed in relation to sensed tension fluctuations.

Preferably, the winding rollers are rotatably mounted in fixed relation to one another on a subframe which is pivotably supported for movement of the winding rollers between their aforementioned operative winding and discharge positions. A piston-and-cylinder assembly or another suitable mechanism is provided for actuating the pivotal movement of the subframe.

The core receiving and supporting arrangement includes a pair of supporting rollers rotatably mounted in spaced axially parallel relation for cooperatively supporting the core peripherally between the supporting rollers, with at least one of the supporting rollers being driven to drive rotation of the core. A mechanism is provided for applying a peripheral wrapping about the core during its rotation by the supporting rollers to prevent undesired unwinding of the sheet of material from the core.

The shear-cutting arrangement preferably includes a cutting blade stationarily mounted at a location intermediate the winding rollers and the core receiving and supporting arrangement to engage one face of the sheet of material transversely across its length following ejection of the core from the winding rollers and another cutting blade mounted for orbital movement about an axis of rotation for movement through an arcuate cutting path into and out of shear-cutting relation with the stationary cutting blade from the opposite face of the sheet of material.

According to another feature of the present invention, a biasing roller is rotatably supported in peripheral contact with the core at a location generally diametrically opposite the winding rollers when the core is supported therebetween in the operative winding position of the winding rollers for maintaining the core in peripheral driven engagement with the winding rollers. A supporting arrangement for the biasing roller is provided for displacing the biasing roller away from the winding roller and for varying the force of contact of the biasing roller with the winding rollers in relation to progressive winding of the sheet of material on the core to maintain a substantially constant force of contact of the core with the winding rollers during the course of the winding operation. Preferably, a detector is associated with at least one of the winding rollers to monitor the weight of the core and the sheet of material wound thereon and is associated with the supporting arrangement for the biasing roller to control displacement thereof and the force of contact of the core with the winding rollers in relation to the progressive winding of the sheet of material on the core.

The present winding apparatus further includes an arrangement, operable following shear-cutting of the sheet of material, to direct a first stream of air against the leading end of the sheet of material following the location of shear-cutting to wrap the leading material end about a replacement core supported on the winding rollers and to also direct a second stream of air against the leading material end when wrapped about the replacement core to insert the leading end into a nip between the replacement core and one of the winding rollers. Instead of a second stream of air, an alternative arrangement may be provided for engaging the leading end of material when wrapped about the replacement core to insert the material into the nip area. In each case, the nip inserting arrangement is preferably mounted on the shear-cutting arrangement for movement therewith. The apparatus also includes a mechanism for dispensing an empty replacement core to the winding rollers following each shear-cutting of the sheet of material.

DETAILED DESCRIPTION OF THE PREFERRED EMBODIMENT

Figure 1:
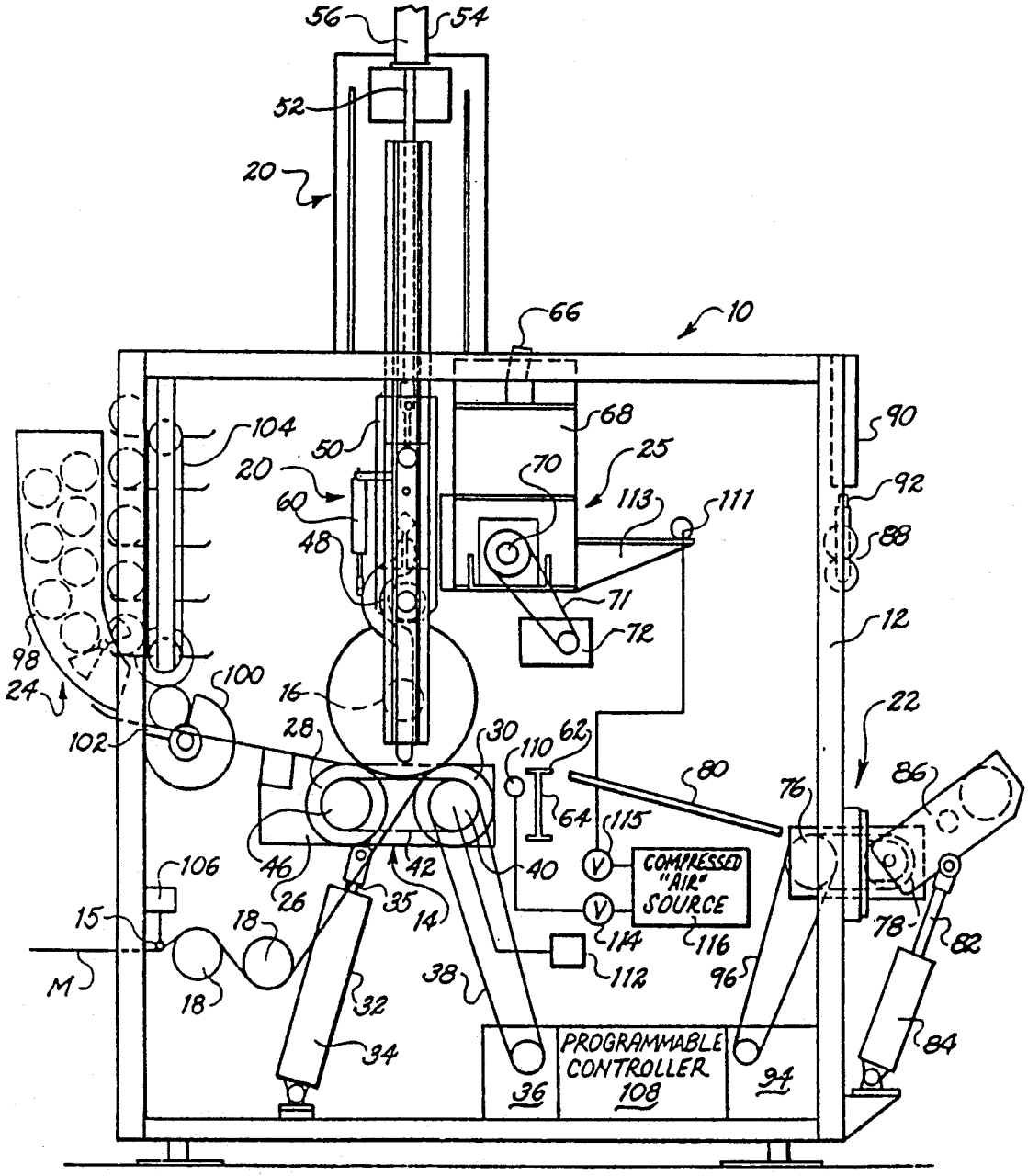
FIGS. 1–7 are partially schematic side-elevational views of a shear-cutting batcher-type winding apparatus according to one preferred embodiment of the present invention, sequentially showing the apparatus in successive stages of operation.

Referring now to the accompanying drawings, a shear-cutting batcher-type winding apparatus according to one preferred embodiment of the present invention is indicated generally at 10 in FIGS. 1–7. The batcher-winding apparatus 10 includes a winding roller assembly, generally indicated at 14, mounted centrally to a frame 12 for rotatably supporting and driving a tubular winding core 16. A floating movable idler roller 15 and a pair of rotatably driven feed rollers 18 are supported in axially parallel relation at the forward end of the frame 12 for receiving a traveling sheet of material M, such as a textile fabric, from a preceding processing station (not shown), such as a textile fabric tenter frame, and directing the sheet material M to the winding roller assembly 14 for peripheral winding about the core 16. A biasing roller assembly, generally indicated at 20; is mounted to the frame 12 directly above the winding roller assembly 14 for maintaining the core 16 in driven engagement with the winding roller assembly 14. A core discharge station, generally indicated at 22, is provided at the rearward end of the frame 12 for receiving and supporting the core 16 once fully-wound to its desired capacity with the sheet material M. A shear-cutting arrangement, generally indicated at 25, is mounted to the frame 12 intermediate the winding roller assembly 14 and the discharge station 22 for transversely severing the trailing extent of the sheet material M following discharge of a fully-wound core 16 from the winding roller assembly 14 to the discharge station 22. A core dispensing assembly, generally indicated at 24, is mounted at the forward end of the frame 12 for delivering empty replacement cores 16 to the winding roller assembly 14 following the discharge of a fully-wound core.

The winding roller assembly 14 includes a subframe 26 to which a pair of winding rollers 28,30 are rotatably mounted in fixed relatively closely spaced axially parallel relation to one another to extend laterally across the frame 12. The subframe 26 is pivotably affixed to the main frame 12 about a pivot axis coaxial with the rotational axis of the winding roller 30. A piston-and-cylinder assembly 32 is pivotably affixed by its cylinder body 34 to the bottom wall of the machine frame 12 immediately beneath the subframe 26 and the outward end of the extensible piston 35 of the piston-and-cylinder assembly 32 is affixed to the underside of the subframe 12 at its non-pivoted free end. In this manner, retraction and extension of the piston-and-cylinder assembly 32 is effective to move the subframe 26 and the winding rollers 28,30 between a normal operative winding position, as shown in FIG. 1, wherein the winding rollers 28,30 are disposed substantially horizontally adjacent one another and a core discharge position, shown in FIG. 3, wherein the winding roller 28 is disposed at a vertical elevation above the winding roller 30 to gravitationally discharge the core 16 from its normally supported disposition on the winding rollers 28,30. The winding roller 30 is driven from an electric drive motor 36 through a drive belt 38 trained in driving engagement with a sprocket 40 coaxially affixed to one end of the winding roller 30. In turn, the winding roller 28 is driven from the winding roller 30 by another belt 42 trained about a second drive sprocket (not shown) on the winding roller 30 and a drive sprocket 46 on the winding roller 28. In this manner, the winding rollers 28,30 are both driven for clockwise rotation, as viewed in the drawings, and, in turn, drive rotation of the core 16 in the opposite counterclockwise direction.

According to the present invention, the described drive arrangement for the winding rolers 28,30 is set up to drive the winding roller 30 at a substantially constant peripheral surface speed substantially identical to the linear traveling speed of the incoming sheet material M. In the winding of most textile fabrics and other similarly stable sheet materials, it is normally desirable to form the successive windings of the sheet material as densely compacted as reasonably practical. Accordingly, the sprockets 44,46 are preferably selected according to the present invention to achieve driving of the winding roller 28 at a substantially constant peripheral surface speed slightly greater than that of the winding roller 30 to insure sufficient tensioning of the material M during winding to densely compact the successive material windings on the core 16. On the other hand, in the winding of textile fabrics having a pile or similarly raised surface and in the winding of other relatively delicate textile fabrics and the like, it is typically desirable to avoid high compaction of the successive material windings to avoid damage to the fabric. In such cases, the winding roller 28 is either driven at substantially the same peripheral surface speed as the winding roller 30 or, alternatively, may be driven at a gradually decreasing peripheral surface speed as the successive windings of the material M progressively build on the core 16 over the course of the winding operation to exert a gradually decreasing tension on the material M and, in turn, achieve a uniform density of the material windings across the full diameter of the wound core 16, thereby avoiding excessive compaction of the initial material windings on the core 16. For this purpose, a separate variable speed drive motor (not shown) may be provided for the winding roller 28 to facilitate modification of the surface speed of the winding roller 28 over the course of the winding operation while the peripheral surface speed of the winding roller 30 may be maintained substantially constant through its respective drive arrangement. In such embodiment, the second drive sprocket on the winding roll 30 is supported coaxially therewith by a bearing for idling rotation relative to the winding roll 30 and its drive sprocket 40 and is directly belt driven by the separate drive motor for the winding roller 28 mounted to the frame 12 in similar fashion to the motor 36, so as not to restrict or interfere with the pivotability of the subframe 26.

The biasing roller assembly 20 includes a piston-and-cylinder assembly 54 whose cylinder body 56 is affixed in an upright vertical disposition to the upper end of the frame 12 immediately above the core support area defined between the winding rollers 28,30, with the extensible piston 52 of the piston-and-cylinder assembly 54 extending vertically downwardly to align with the rotational axis of a core 16 supported by the winding rollers 28,30. A cylindrical biasing roller 48 is rotatably mounted to a support frame 50 affixed to the free end of the extensible piston 52 for idling peripheral surface engagement with a core 16 supported by the winding rollers 28,30. A pair of retainer arms 58 are pivotably affixed to the opposite lateral ends of the support frame 50 to extend downwardly therefrom outwardly adjacent opposite ends of the core 16 to prevent axial movement of the core 16 relative to the winding rollers 28,30 during winding operation. An auxiliary piston-and-cylinder assembly 60 is mounted to the support frame 50 and to the retainer arms 58 for selectively pivoting the retainer arms laterally from the biasing roller 48 when the piston 52, the support frame 50 and the biasing roller 48 are retracted upwardly away from the winding roller assembly 14 (FIGS. 2–5). The biasing roller assembly 20 is thus operative upon extension of the piston 52 to urge the core 16 into idling peripheral surface contact with the winding rollers 28,30 by contacting the biasing roller 48 peripherally with the upwardly facing side of the core 16 generally diametrically opposite the winding rollers 28,30.

As will be understood, as the sheet material M progressively winds about the core 16, the overall weight of the core 16 increases correspondingly and, in turn, a gradually lessening biasing force on the core 16 is required of the biasing roller assembly 20. Likewise, the progressive winding of the sheet material M about the core 16 gradually increases the overall diameter of the core 16 so that a gradually lessening degree of extension of the piston 52 is required over the course of the winding operation. Accordingly, in the preferred embodiment of the present invention, the operation of the piston-and-cylinder assembly 54 is controlled in relation to the progressively increasing diameter of the core 16 and the progressively increasing weight thereof to gradually retract the piston 52 and gradually exert a decreasing force of contact by the biasing roller 48 peripherally against the core 16 over the course of the winding operation.

The shear-cutting assembly 25 includes an elongate cutting blade 62 fixed to an anvil 64 mounted stationarily across the lateral extent of the frame 12 immediately rearwardly adjacent the subframe 26. The elongate extent of the cutting blade 62 is slightly greater than the maximum widthwise extent of the sheet material M for which the winding apparatus 10 is designed. Another elongate cutting blade 66 is mounted at the outward end of an arm assembly 68 extending laterally across the frame 12 at a spacing directly above the anvil 64, the arm assembly 68 being fixed to a rotatable shaft 70 for orbital movement of the cutting blade 66 about the shaft 70 including an arcuate cutting path passing tangentially in shear-cutting relation with the stationary cutting blade 62. Rotational operation of the shaft 70 is actuated by an electric drive motor 72 mounted to the frame 12 and drivingly connected to one end of the shaft 70 by a drive belt 71.

Figure 5:
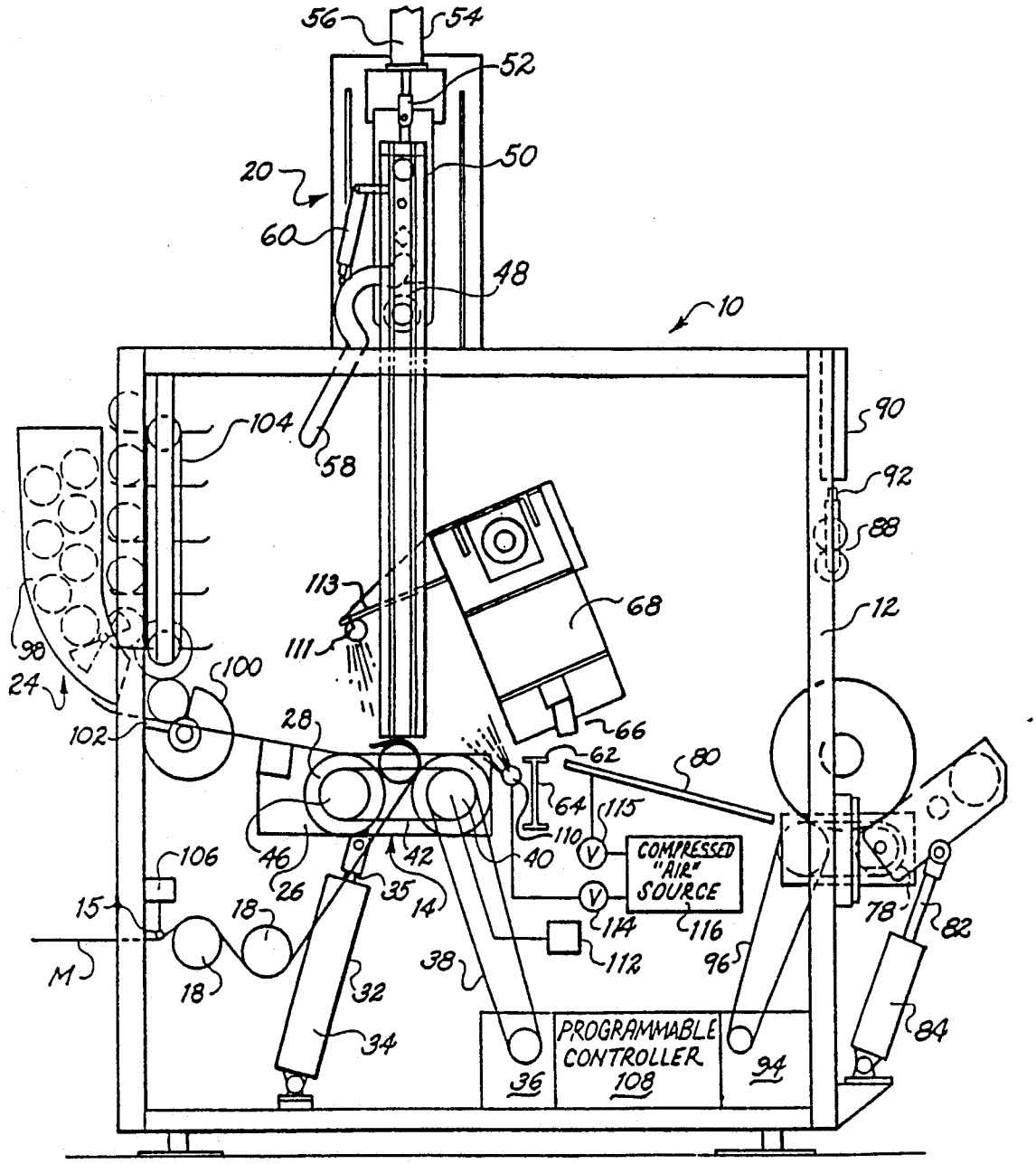

As more fully explained hereinafter, the shear-cutting assembly 25 is operated following discharge of a fully-wound core 16 from the winding roller assembly 14 by pivoting operation of its subframe 26, by which the fully-wound core 16 is transferred to the discharge station 22 leaving a trailing length of the sheet material M extending in contact across the cutting blade 62 and anvil 64. After operation of the cutting assembly 25 to shear-cut the sheet material M transversely across its length, the leading edge of the extent of sheet material M following the location of the cut must be wrapped about a new empty replacement core 16 in order to continue the winding operation. The replacement core 16 is delivered into supported position between the winding rollers 28,30 by the dispenser arrangement 24 following the discharge of the previously wound core 16 from the winding roller assembly 14 and in advance of the shear-cutting of the sheet material M by the cutting assembly 25, as hereinafter described, whereby the trailing extent of the sheet material M is captured between the replacement core 16 and the winding roller 30. To facilitate wrapping of the cut end of the sheet material M about the replacement core 16 following the cutting operation, a first compressed air discharge nozzle 110 is affixed transversely to the frame 12 intermediate the winding roller 30 and the anvil 64, with air emission openings in the nozzle 110 directed angularly upwardly and forwardly to direct the emitted air to impact against the underside of the sheet material M. Additionally, another air discharge nozzle 111 is mounted at the outward end of a leg 113 extending outwardly in cantilevered fashion from the cutter arm assembly 68 at the side thereof which trails the rotational direction of cutting movement of the arm assembly 68, the air discharge nozzle 111 having air emission openings oriented to discharge air downwardly at the nip area between the core 16 and the winding roller 28 as the cutting arm assembly 68 passes through its cutting arc, as shown in FIG. 5. The air discharge nozzles 110,111 are communicated with a suitable source of compressed air 116 through respective openable and closeable valves 114,115 for selectively controlling admission of compressed air into the nozzles 110,111 for emission as hereinafter more fully explained.

Figure 6:
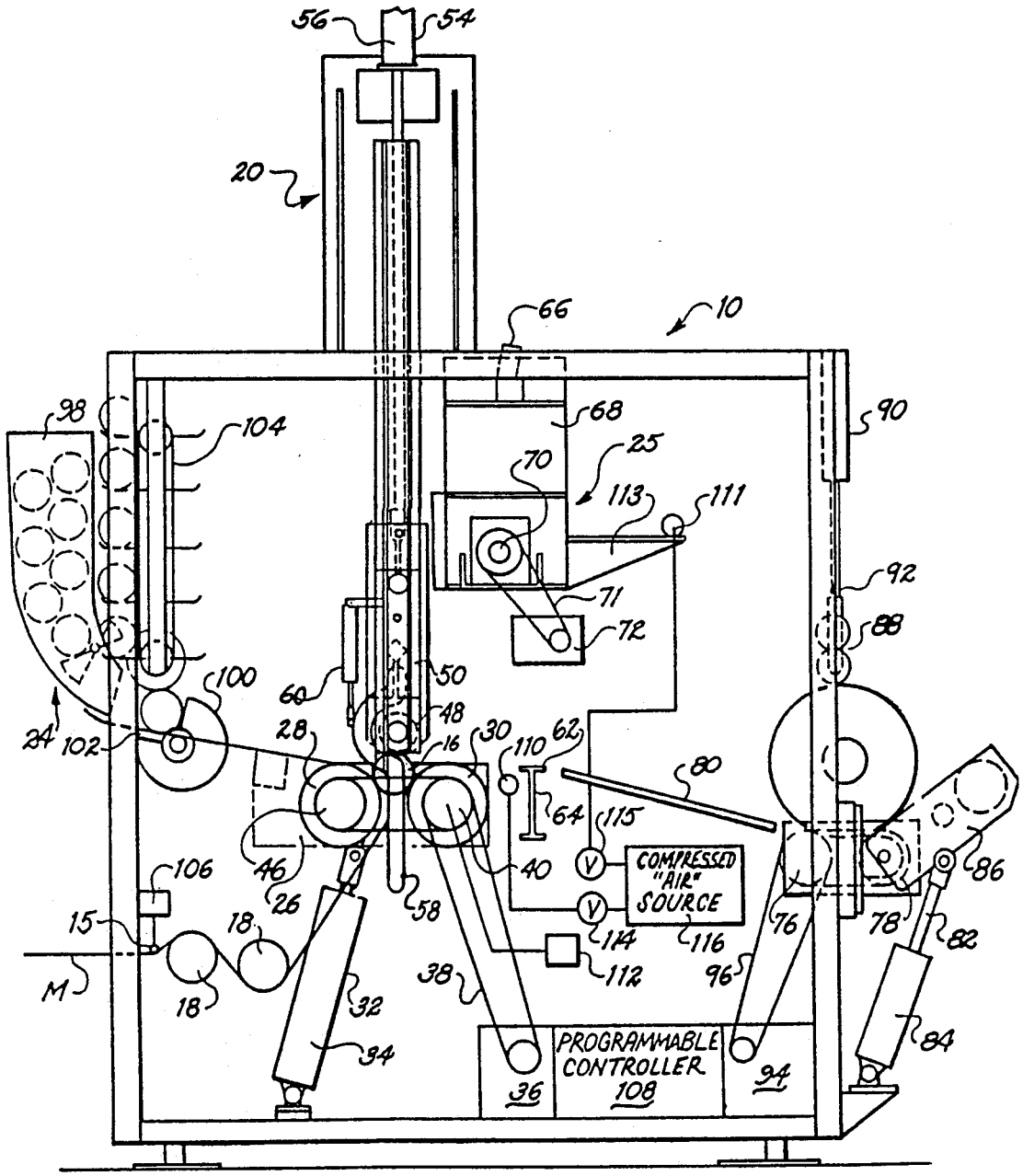
Figure 7:
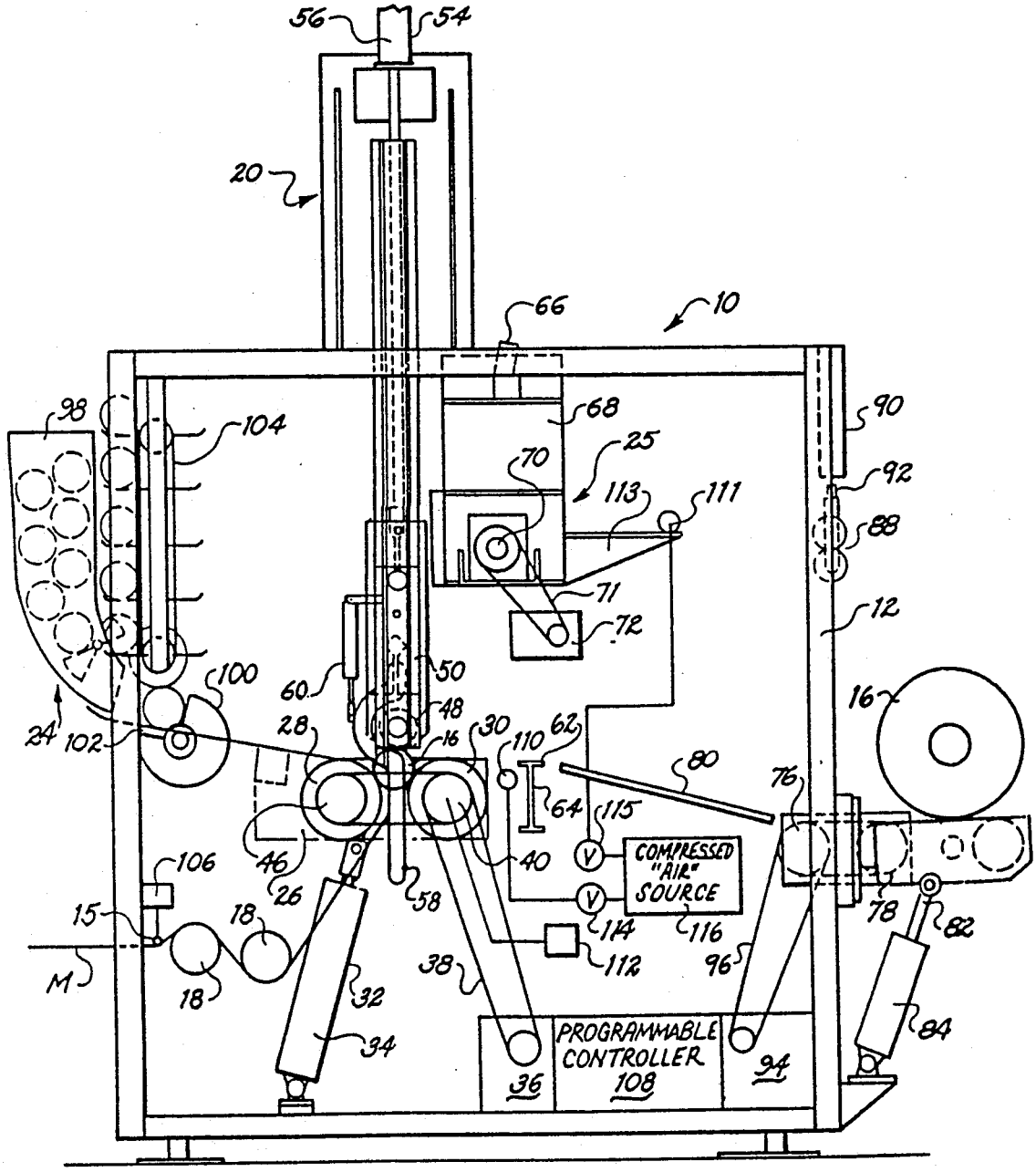
Figure 8:
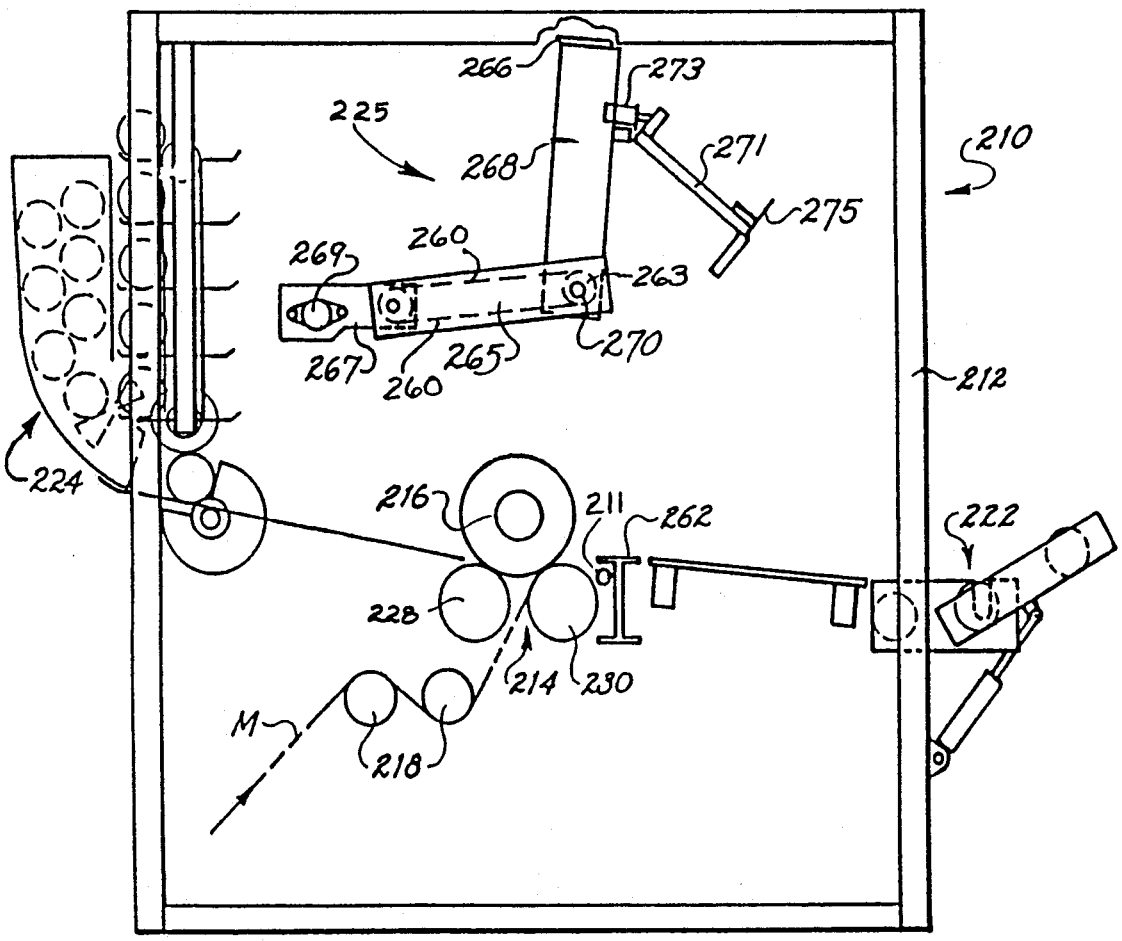
FIGS. 8–12 are similar partially schematic side-elevational views of another embodiment of shear-cutting batcher-type winding apparatus according to another preferred embodiment of the present invention.

The discharge station 22 includes a pair of supporting rollers 76,78 rotatably mounted to the rearward end of the frame 12 extending laterally thereacross horizontally adjacent to one another in relatively closely spaced axially parallel relation for cooperatively supporting the core 16 peripherally between the supporting rollers 76,78. A ramp 80 extends at a slightly downward incline from the anvil 64 to the supporting roller 76 for directing a fully-wound core 16 into supported disposition resting between the supporting rollers 76,78 when the subframe 26 of the winding roller assembly 14 is pivoted to eject a fully-wound core 16. A retaining shelf 86 is pivotably mounted to the rearward end of the frame 12 coaxially with the supporting roller 78 and is affixed to the extensible piston 82 of a piston-and-cylinder assembly 84 mounted to the frame 12 beneath the shelf 86 for pivoting movement of the shelf 86 between a core retaining position extending at an upward incline relative to the supporting rollers 76,78, as shown in FIGS. 1–6, and a core discharge position extending horizontally outwardly in general alignment with the supporting rollers 76,78, as shown in FIG. 7. Thus, in the core retaining position of the shelf 86, the shelf 86 acts to prevent possible rolling movement of the core 16 from the ramp 80 over and beyond the supporting rollers 76,78 to insure that the core 16 comes to rest between the supporting rollers 76,78. In the core discharge position, the shelf 86 provides a convenient surface on which the core 16 may be readily rolled from its supported position on the supporting rollers 76,78 for removal from the winding apparatus 10.

The discharge station 22 also includes a tape dispensing mechanism 88 mounted directly above the supporting rollers 76,78 at the downwardly extending end of the extensible piston 92 of another piston-and-cylinder assembly 90 for selective movement of the tape dispensing assembly 88 into and out of peripheral surface engagement with a fully-wound core 16 when supported by the supporting rollers 76,78. One or both of the supporting rollers 76,78 is driven from an electric drive motor 94 by a drive belt arrangement 96 for rotating a fully-wound core 16 supported on the supporting rollers 76,78. When the tape dispensing assembly 88 is advanced by the piston-and-cylinder assembly 84 into peripheral surface contact with a rotating core 16 on the supporting rollers 76,78, the tape dispensing assembly 88 is operative to peripherally apply one or more wrappings of tape or another suitable wrapping material peripherally about the fully-wound core 16 to secure the sheet material M from undesired unwinding from the core 16.

The core dispensing arrangement 24 includes a hopper 98 for storing a quantity of empty replacement cores 16 and delivering the replacement cores 16 individually to a dispenser 100. The dispenser 100 has a substantially cylindrical body having a segmented compartment 102 formed in its periphery and is selectively reciprocable about a central rotational axis between a loading position wherein the compartment 102 faces the discharge opening of the hopper 98 to receive an empty core 16 therefrom, as shown in FIG. 1, and a feeding position wherein the compartment 102 faces the subframe 26 for depositing a replacement core from the compartment 102 onto the subframe 26 to roll therealong and be received between the winding rollers 28,30. Reciprocal movement of the dispenser 100 is actuated by the electric drive motor 72 drivingly connected to the axial shaft of the dispenser 100 through an intermediate drive train (not shown) for coordination of the dispenser 100 with the cutting operation of the shear-cutting arrangement 25. As an alternative to the hopper 98, empty replacement cores 16 may be individually delivered to the dispenser 100 by an endless conveyor 104 positioned immediately above the dispenser 100, as shown in broken lines in FIG. 1.

Operational control of the drive motor or motors for the winding rollers 28,30, the piston-and-cylinder assembly 32 for the winding roller subframe 26, the piston-and-cylinder assembly 54 and the auxiliary piston-and-cylinder assembly 60 of the biasing roller assembly 20, the drive motor 72 for the cutting arm assembly 68, the drive motor 94 for the supporting rollers 76,78, the piston-and-cylinder assembly 84 for the shelf 86, the piston-and-cylinder assembly 90 for the tape dispensing assembly 88, and the compressed air supply valve 114 associated with the air discharge nozzles 110,111 is provided by a central microprocessor or other programmable controller, only representatively indicated at 108. The microprocessor 108 is programmed to actuate and deactuate the respective mechanisms in a predetermined manner and sequence as hereinafter described. As will be understood, the establishment of a desired substantially constant driven peripheral surface speed of the winding roller 30 to be essentially equivalent to the linear traveling speed of the incoming sheet material M, and in turn the driving of the winding roller 28 at a related peripheral surface speed, assumes the optimal condition of a substantially constant traveling speed of the sheet material M and, in turn, a substantially uniform tension of the sheet material M. While these optimal conditions are always sought to be achieved, it will be recognized that in actual practice deviations in the traveling speed and tension of the sheet material M occur. Accordingly, to compensate for such tension and speed fluctuations in the sheet material M, a load cell 106, preferably in the form of an electronic transducer, is associated with the idler roller 15 to monitor tension fluctuations in the incoming sheet material M and, in turn, the load cell 106 is operatively connected to the central microprocessor 108 to deliver thereto a variable input corresponding to the sensed variations. The microprocessor 108 is programmed to adjust the driving speed of the electric drive motor or motors to the winding rollers 28,30 to offset the fluctuations detected by the load cell 106. Another electronic transducer or other load cell 112 is operatively connected to one or both of the winding rollers 28,30 to monitor the gradually increasing overall weight of the core 16 as the sheet material M is progressively wound thereon, the load cell 112 also being operatively connected with the central microprocessor 108 to deliver a variable signal thereto representative of the increasing core weight. The microprocessor 108, in turn, is programmed to adjust operation of the piston-and-cylinder assembly 54 to the biasing roller 48 to control its retraction and vary the force exerted thereby against the core 16 in relation to the increasing core weight, for the reasons aforementioned.

The operation of the present batcher-type winding apparatus 10 as program-controlled by the microprocessor 108 may thus be understood. The normal operating condition of the winding apparatus 10 in its material winding mode is depicted in FIG. 1. In normal winding operation, the sheet material M is delivered under the idler roller 15, over the forwardmost feed roller 18, then under the rearwardmost feed roller 18 and therefrom to the nip area between the winding roller 30 and the winding core 16. The driven rotation of the winding rollers 28,30 in a clockwise direction effects driven rotation of the winding core 16 in the opposite counterclockwise direction, whereby the incoming traveling sheet material M progressively winds about the core 16. As aforementioned, during the normal winding operation, the microprocessor 108 controls the drive motor 36 to drive the winding roller 30 at a substantially constant peripheral surface speed essentially equaling the linear traveling speed of the incoming sheet material M, with the winding roller 28 being driven at a predetermined related peripheral surface speed, either through the belt 42 from the winding roller 30 or through a separate drive motor also controlled by the microprocessor 108, the driven speed of the winding roller 28 either being substantially constant at slightly greater than or substantially the same as the winding roller 30 or being gradually reduced over the course of the winding operation to control the compaction of the sheet material M in a desired manner. The load cell 106 continuously monitors fluctuations in the tension of the incoming sheet material M and the microprocessor 108 adjusts the driven speed of the winding roller 30 and the winding roller 28 to offset such fluctuations.

As the core 16 is gradually built with windings of the sheet material M, the microprocessor 108 controls the piston-and-cylinder assembly 54 to the biasing roller 48 to maintain the biasing roller 48 in idling peripheral surface contact with the core 16, while gradually retracting the piston 52 as the overall diameter of the winding core 16 increases and also gradually varying the downward force exerted by the piston-and-cylinder assembly 54 to progressively decrease the force of contact by the biasing roller 48 against the winding core 16 as its weight gradually increases from the progressive windings of the sheet material M. The load cell 112 continuously monitors the increasing weight of the winding core 16 and inputs a corresponding weight signal to the microprocessor 108, which responsively controls operation of the piston-and-cylinder assembly 54 according to the predetermined program. Alternatively, the microprocessor 108 may be programmed to control the piston-and-cylinder assembly 54 in relation to the peripheral surface speed of the winding rollers 28,30 and predetermined parameters of the particular type of sheet material M.

Figure 2:
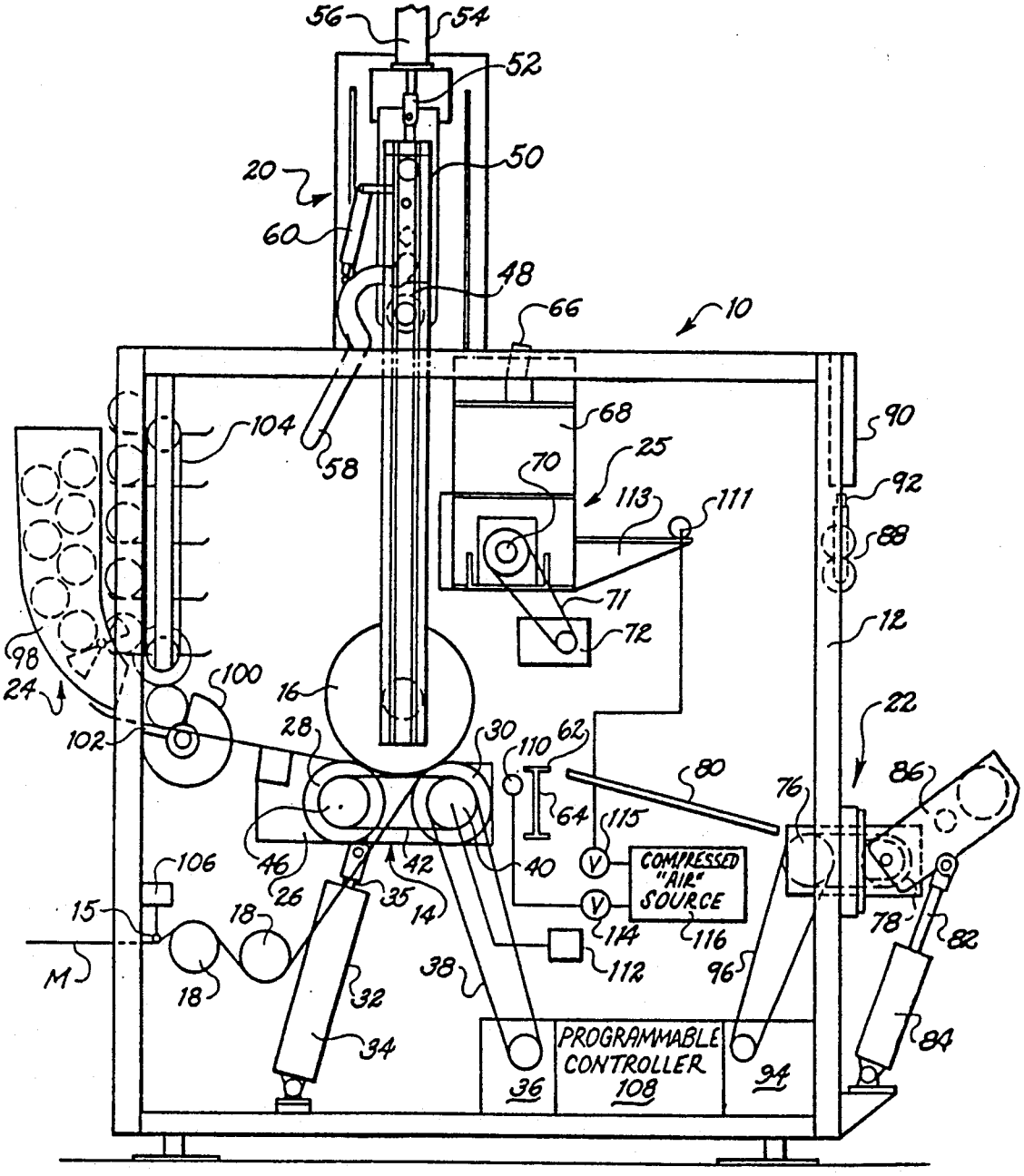
Figure 3:
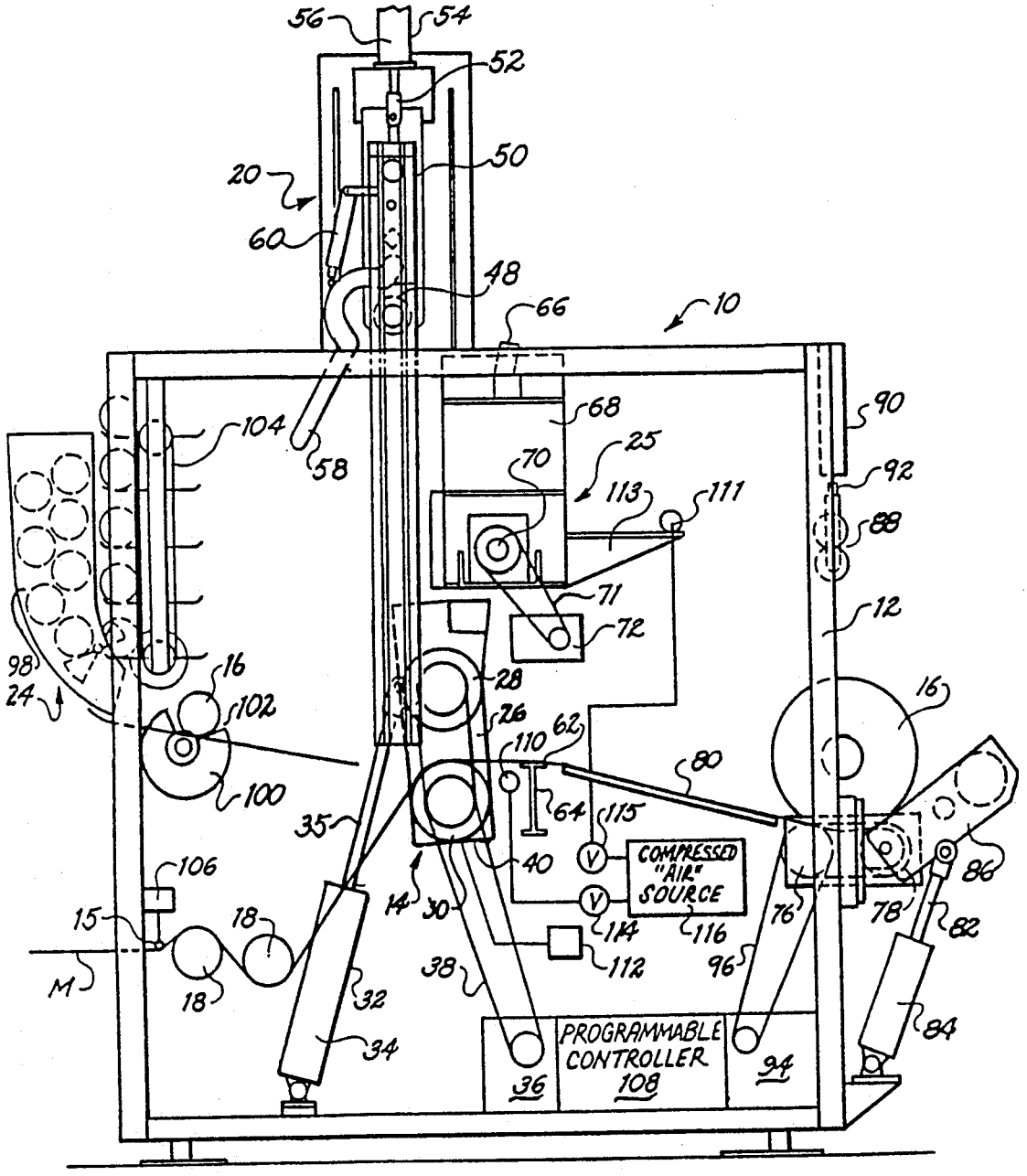

As shown in FIG. 1, the core 16 in winding operation is just reaching its desired fully-wound capacity, which for example may be determined by preprogramming the microprocessor 108 with a maximum total weight value of the core 16. Alternatively, the microprocessor 108 may be programmed with a maximum total yardage or other appropriate length value of the material M wound on the core 16, as may be measured by any suitable conventional means. When the winding core 16 reaches its full capacity, the microprocessor 108 operates the piston-and-cylinder assembly 54 to fully retract the piston 52 to withdraw the biasing roller 48 upwardly out of contact with the winding core 16 to a location beyond the upper extent of the main frame 12. During the upward retraction of the piston 52, the auxiliary piston-and-cylinder assembly 60 is retracted to pivot the retaining arm 58 forwardly of the frame 12, all as depicted in FIG. 2. In this retracted disposition, the biasing roller assembly 20 is thereby removed from interference with the rotational orbit of the cutting assembly 25. Following retraction of the biasing roller assembly 20, the microprocessor 108 initiates extension of the piston-and-cylinder assembly 32 to pivot the subframe 26 of the winding roller assembly 14 upwardly to its discharge position wherein the fully-wound core 16 is gravitationally ejected from its resting disposition on the winding rollers 28,30 and rolls along the ramp 80 to a resting disposition supported between the supporting rollers 76,78 at the discharge station 22, the shelf 86 remaining upwardly inclined to prevent the core 16 from rolling past the support rollers 76,78, as shown in FIG. 3. The unwound extent of the sheet material M trailing from the fully-wound core 16 thus extends along the ramp 80 and over the cutting blade 62 and the winding roller 30. The piston-and-cylinder assembly 32 is then retracted to return the subframe 26 to its original operative winding position to be out of interference with the rotational orbit of the cutting assembly 25.

Figure 4:
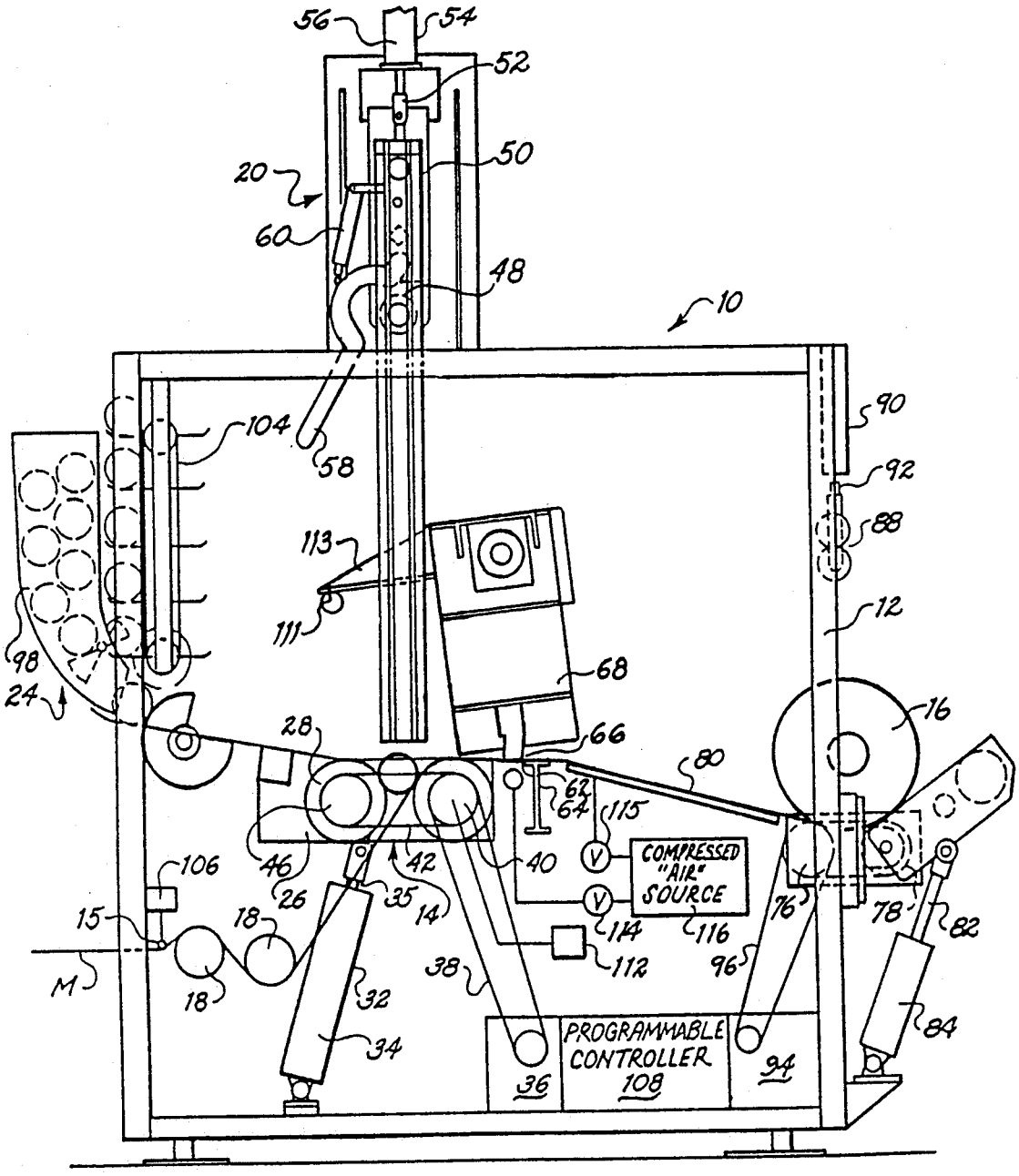

As shown in FIG. 4, the dispenser 100 is rotated clockwise upon return of the subframe 26 to its operative winding disposition to deliver an empty replacement core 16 along the subframe 26, the replacement core 16 coming to rest between the winding rollers 28,30 wherein the sheet material M is pinched in the resultant nip area between the replacement core 16 and the winding roller 30. At substantially the same time, the microprocessor 108 actuates the drive motor 72 of the cutting assembly 25 to initiate a rotational orbit of the cutting arm assembly 68. As the cutting arm assembly 68 passes through the lowermost arcuate extent of its overall rotational orbit, the cutting blade 66 on the arm assembly 68 passes in shear-cutting engagement with the stationary cutting blade 62 on the anvil 64 to cut the sheet material M resting on the cutting blade 62 transversely across the full extent of its width.

Immediately following cutting of the sheet material M, the microprocessor 108 opens the valve 114 associated with the air discharge nozzle 110 to deliver compressed air into the nozzle 110 for emission through its air emission openings. The air discharged through the nozzle 110 initially contacts the underside of the leading end portion of the extent of the sheet material M following the location of the cut to direct the leading end upwardly over the empty replacement core 16 resting between the winding rollers 28,30. As the cutting arm assembly 68 continues its rotational orbit past cutting engagement with the cutting blade 62, the microprocessor 108 opens the valve 115 associated with the air discharge nozzle 111 to deliver compressed air into the nozzle 111 for emission through its air discharge openings. The compressed air discharged through the nozzle 111 on the cantilevered leg 113 of the arm assembly 68 contacts the leading edge of the sheet material M wrapped over the core 16 by the air discharge nozzle 110 and serves to insert and tuck the leading material edge into the nip area between the replacement core 16 and the winding roller 28. This point in the operation of the winding apparatus 10 is depicted in FIG. 5. As will thus be understood, the leading edge of the sheet material M is thereby sufficiently wrapped about the replacement core 16 for winding operation of the apparatus 10 to resume, without requiring the conventional necessity of applying adhesive to the outer periphery of a replacement core to retain the leading edge of the material. As shown in FIG. 6, the winding operation is then resumed by again extending the piston-and-cylinder assembly 54 to bring the biasing roller 48 into peripheral contact with the replacement core 16.

Following completion of the cutting of the sheet material M by the cutting assembly 25, the microprocessor 108 also actuates the drive motor 94 to the supporting rollers 76,78 to drive rotation of the discharged fully-wound core 16 supported thereon to wind thereabout the trailing length of the sheet material M extending from the fully-wound core 16 along the ramp 80 to the cutting blade 62. Thereupon, the microprocessor 108 actuates the piston-and-cylinder assembly 90 to extend its piston 92 bringing the tape dispensing assembly 88 into peripheral surface contact with the rotating fully-wound core 16 to apply one or more wrappings of tape thereabout to secure the trailing edge of the sheet material M against undesired unwinding, as also depicted in FIG. 6. As shown in FIG. 7, the shelf 86 is lowered by actuation of the piston-and-cylinder assembly 84 following retraction of the piston-and-cylinder assembly 90 and its tape dispensing assembly 88, thereby to facilitate removal of the fully-wound core 16 for transportation to a storage location or to another processing station.

As will thus be understood, the batcher-type winding apparatus 10 of the present invention provides a compact and relatively simplified arrangement for carrying out the winding of traveling sheet material onto supporting cores in a substantially continuous, uninterrupted and fully-automated fashion. As aforementioned, the shear-cutting of the sheet material provides the advantages of a precise, tensionless and relatively clean cutting of the material with minimal risk of tearing or otherwise damaging the material and, furthermore, renders the apparatus 10 suitable for the winding of a wide variety of materials, including particularly materials which are normally difficult to cut. The above-described arrangement for driving the winding rollers 28,30 further provides the advantage of enabling the winding compaction of the sheet material to be selectively controlled so that, as desired, the material may be densely wound with a high degree of compaction or, alternatively, a uniform winding density of the material may be achieved to control fabric compaction without applying tensioning to the moving sheet material for avoiding damage to delicate materials such as pile and raised surface textile fabrics, stretchable fabrics comprised of rubberized yarn, and the like.

Referring now to FIGS. 8–12, another embodiment of the shear-cutting batcher-type winding apparatus of the present invention is indicated generally at 210. The batcher-winding apparatus 210 includes a winding roller assembly, generally indicated at 214, mounted centrally to a frame 212 for rotatably supporting and driving a tubular winding core 216. The winding roller assembly 214 includes a pair of driven winding rollers 228,230 rotatably mounted directly to the frame 212 in fixed relatively closely spaced axially parallel relation to one another extending laterally across the frame 212. Driven feed rollers 218 are supported in axially parallel relation at the forward end of the frame 212 for receiving a traveling sheet of material M and directing the sheet material M to the winding roller assembly 214 for peripheral winding about the core 216. A biasing roller assembly such as the assembly 20 of FIGS. 1–7 may be omitted in this embodiment or optionally may be mounted to the frame 212 directly above the winding roller assembly 214 for maintaining the core 216 in driven engagement with the winding roller 214. A core discharge station, generally indicated at 222, of substantially the same construction and operation as the core discharge station 22 of FIGS. 1–7, is provided at the rearward end of the frame 212 for receiving and supporting the core 216 once fully-wound to its desired capacity with the sheet material M. A shear-cutting arrangement, indicated generally at 225, is mounted to the frame 212 intermediate the winding roller assembly 214 and the discharge station 222 for transversely severing the trailing extent of the sheet material M following discharge of a fully-wound core 216 from the winding roller assembly 214 to the discharge station 222. A core dispensing assembly, generally indicated at 224, is mounted at the forward end of the frame 212 for delivering empty replacement cores 216 to the winding roller assembly 214 following the discharge of a fully-wound core. The winding apparatus 210 may also be provided with a tape dispensing assembly (not shown) similar to the tape dispensing assembly 88 of FIGS. 1–7.

The winding roller assembly 214 in this embodiment does not include a pivotable subframe for gravitationally discharging a fully-wound core 216 as in the embodiment of FIGS. 1–7, the winding rollers 228,230, as mentioned, being rotatably mounted in fixed disposition directly to the frame 212. Instead, the shear-cutting arrangement 225 is operative additionally to physically discharge a fully-wound core 216 from the winding roller assembly 214 shortly in advance of transversely severing the sheet material M trailing from the discharged core 216. The shear-cutting assembly 225 includes an elongate cutting blade 262 fixed stationarily across the lateral extent of the frame 212 immediately rearwardly adjacent the winding roller 230. A compressed air discharge nozzle 211 is mounted to the frame intermediate the winding roller 230 and the cutting blade 262 and is provided with air emission openings directed angularly upwardly and forwardly. Another elongate cutting blade 266 is mounted at the outward end of an arm assembly 268 laterally across the frame 212 at a spacing directly above the cutting blade 262. The arm assembly 268 is fixed to a driven rotatable shaft 270 for orbital movement of the cutting blade 266 through a circular path passing tangentially in shear-cutting relation with the stationary cutting blade 262. The shaft 270 is rotationally belt-driven in a counterclockwise direction (as viewed in the drawings) by an electric drive motor (not shown) mounted to the frame 212. A pair of support arms 265 are fixed to opposite ends of the shaft 270 to extend radially outwardly therefrom at slightly greater than a 90 degree spacing in advance of the cutting blade 266 in the counterclockwise direction of its cutting movement, thereby to rotate integrally with the shaft 270 and the cutting blade 266 in leading relation thereto. A pair of mounting arms 267 are pivotably affixed respectively at the radially outward ends of the support arms 265 with a discharge roller 269 being fixed to the mounting arms 267 to extend laterally therebetween. Pivotal movement of the mounting arms 265, 267 with respect to one another is controlled by a pair of toothed sprockets 261, 263 mounted respectively at the pivot axis between the arms 265 and 267 and to the drive shaft 270 of the arm assembly 268 and a chain 260 trained about the sprockets 261, 263. Another mounting arm 271 is pivotably affixed to the arm assembly 268 adjacent its radially outward end to extend outwardly therefrom opposite to the direction of counterclockwise rotation of the arm assembly 268 to rotate integrally therewith in relative following relation thereto. A piston-and-cylinder assembly 273 extends between the arm assembly 268 and the mounting arm 271 for actuating and controlling relative pivotal movement of the mounting arm 271 with respect to the arm assembly 268. A series of fingers 275 are mounted along the lateral extent of the mounting arm 271 at its radially outward end, with the fingers 275 extending in the direction of counterclockwise rotation of the mounting arm 271.

As in the embodiment of FIGS. 1–7, operational control of the drive motors for the winding rollers 228,230 and the cutting arm assembly 268, as well as all other mechanisms of the batcher-type winding apparatus 210 is provided by a central microprocessor, not shown in FIGS. 8–12 for sake of simplicity.

Figure 9:
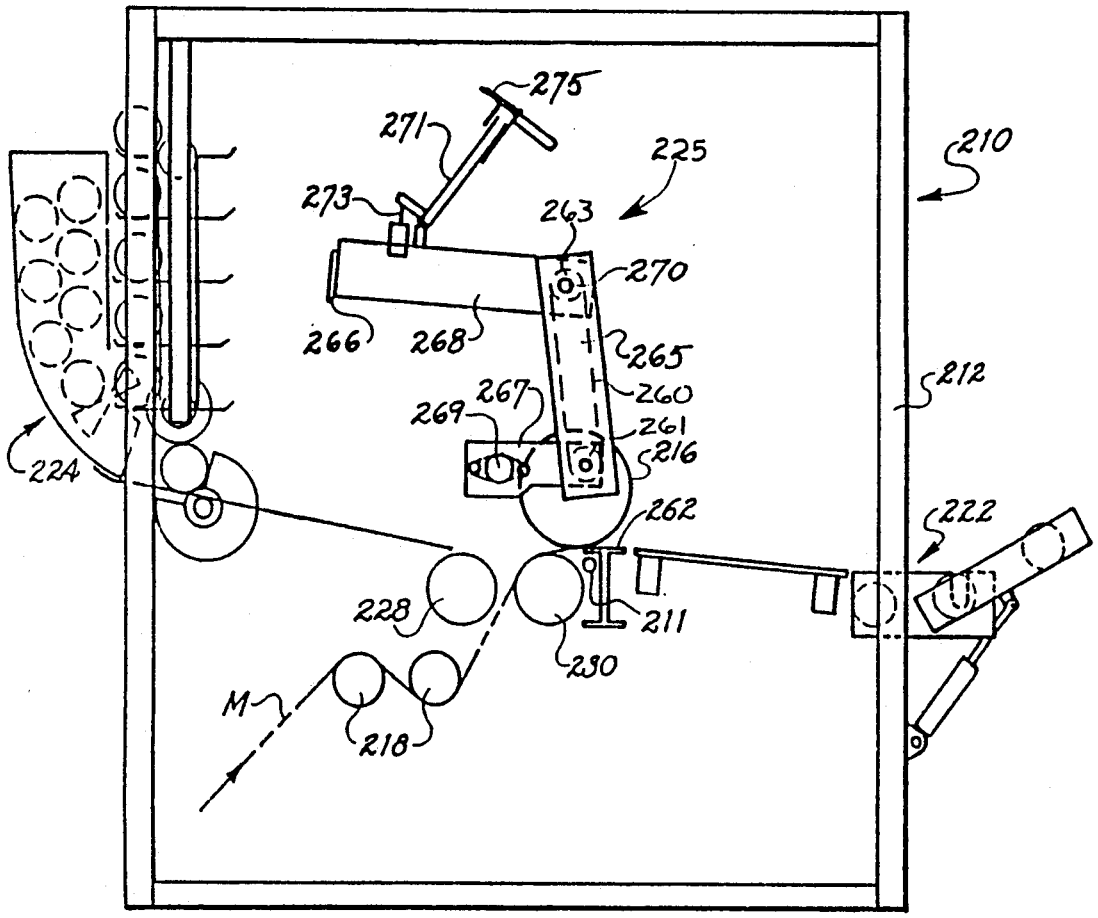
Figure 10:
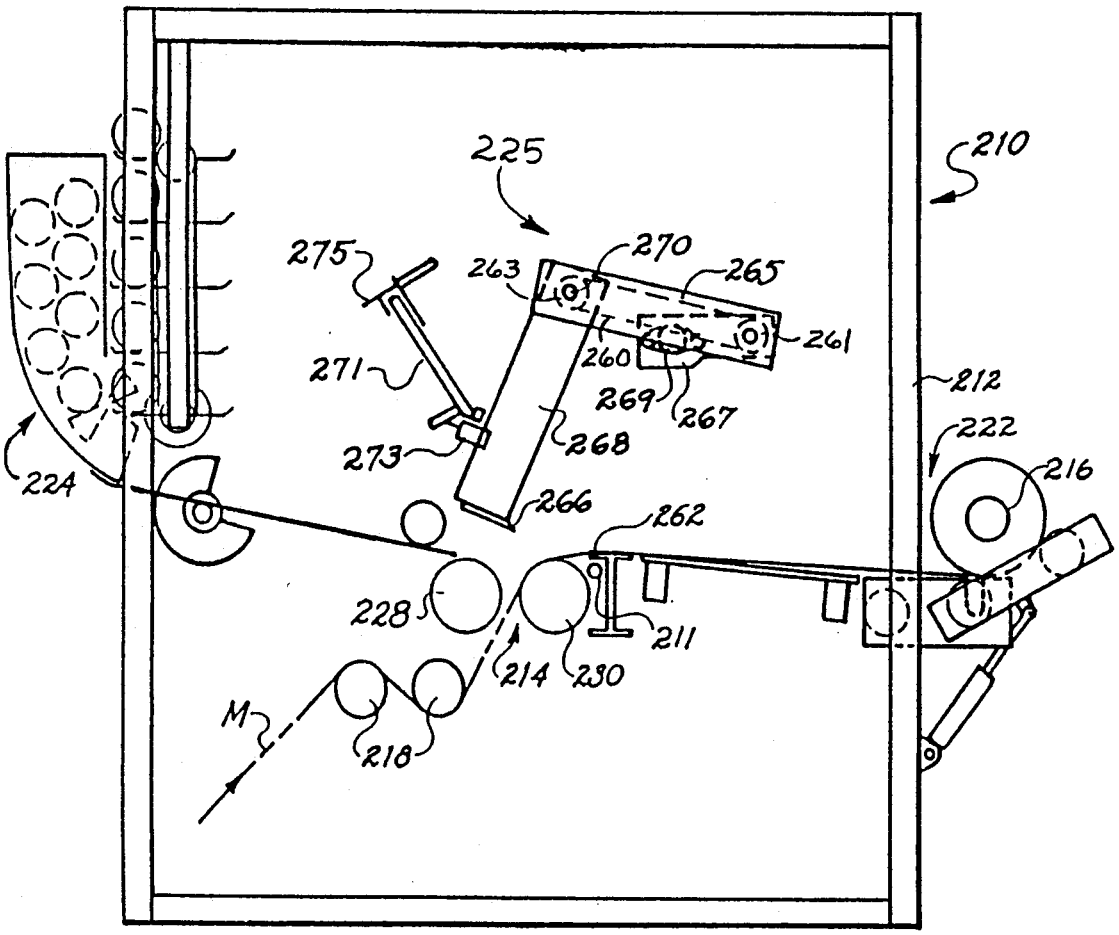
Figure 11:
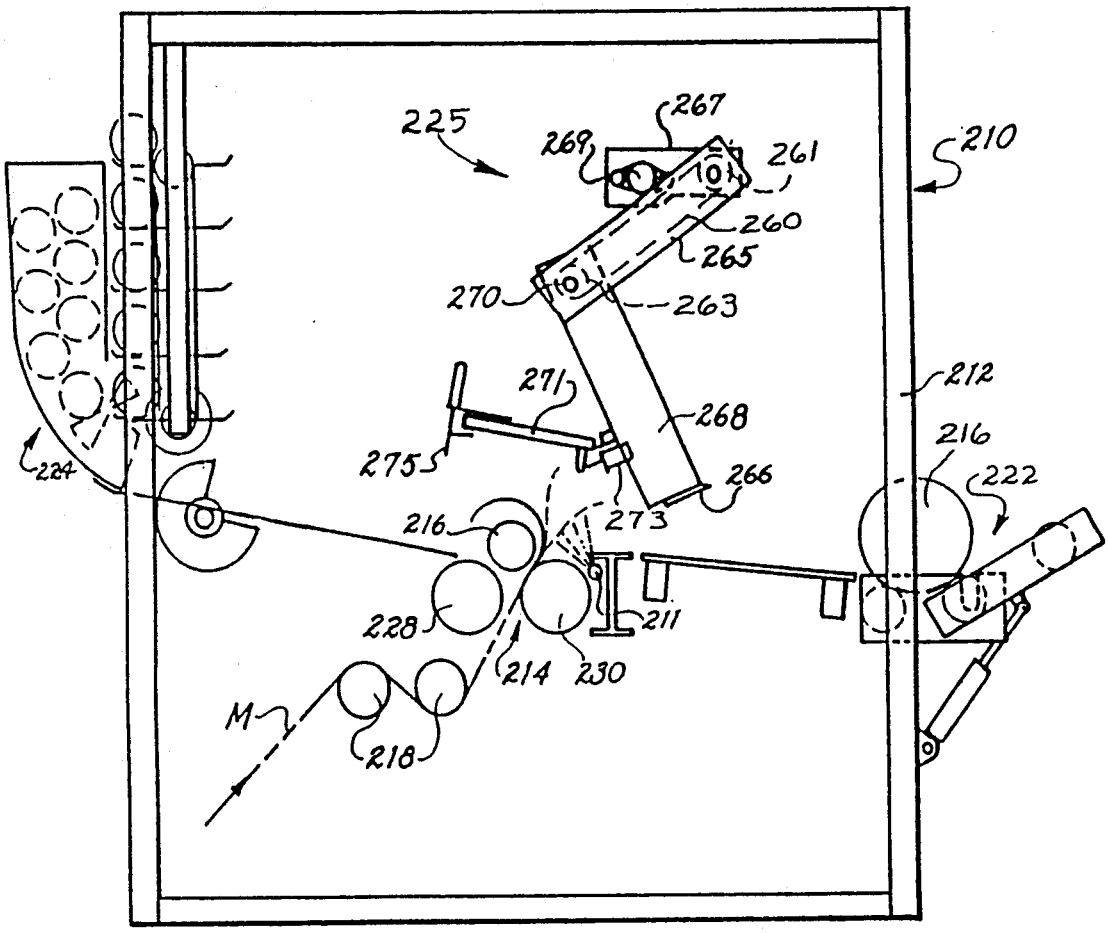
Figure 12:
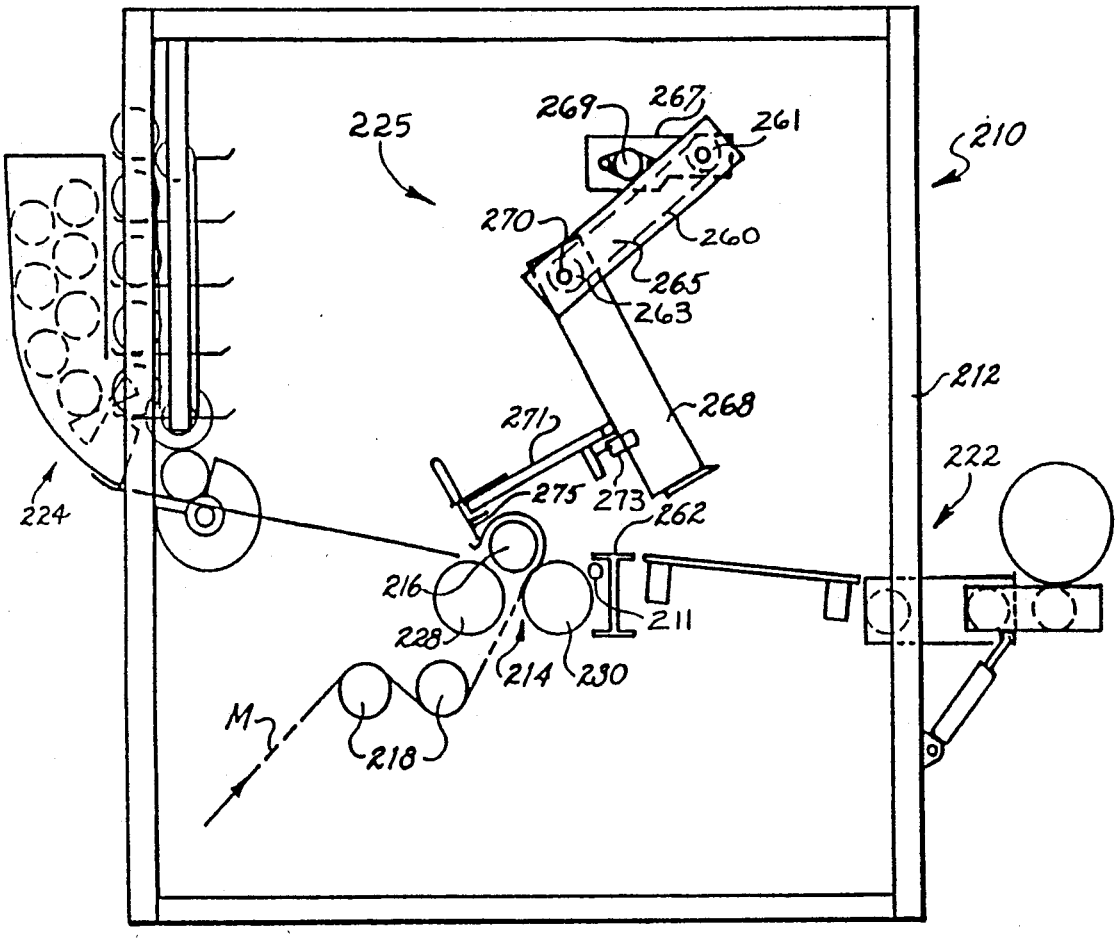

The operation of the batcher-type winding apparatus 210 may thus be understood. Normal winding operation of the winding apparatus 210 progresses in substantially the same manner as above-described with respect to the embodiment of FIGS. 1–7, the normal operating condition of the winding apparatus 210 in its material winding mode being depicted in FIG. 8 wherein the core 216 in winding operation is shown as having just reached its desired fully-wound capacity. Thereupon, the controlling microprocessor initially retracts the biasing roller assembly, if such is utilized, and then actuates the drive motor to the shear-cutting assembly 225 to initiate counterclockwise rotation of the shaft 270. As the arm assembly 268 rotates, the mounting arms 267 are manipulated by the chain and sprocket arrangement 260,261,263 to position the discharge roller 269 to initially engage the fully-wound core 216 and push it from its supported disposition on the winding rollers 228,230 over the stationary cutting blade 262 thereby to discharge the core 216 to the discharge station 222, as depicted in FIGS. 9 and 10. The unwound extent of the sheet material M trailing from the fully-wound core 216 thus extends over the stationary cutting blade 262 and the winding roller 230. Following discharge of the fully-wound core 216 in this manner, the core dispensing assembly 224 is operated to deliver an empty replacement core 216 into resting disposition between the winding rollers 228,230, pinching the sheet material M between the replacement core 216 and the winding roller 230, as shown in FIGS. 10 and 11. As the shaft 270 continues its rotation, the cutting blade 266 of the cutting arm assembly 268 passes through the lowermost arcuate extent of its overall rotational orbit in shear-cutting engagement with the stationary cutting blade 262 to transversely sever the sheet material M resting on the cutting blade 262. Immediately following cutting of the sheet material M, compressed air is delivered into and emitted from the air discharge nozzle 211 to contact the underside of the leading end portion of the extent of the sheet material M following the location of the cut to direct the leading end upwardly over the empty replacement core 216 resting between the winding rollers 228,230. This point in the operation of the winding apparatus 210 is depicted in FIG. 11. Thereafter, the piston-and-cylinder assembly 273 is retracted to bring the mounting arm 271 into essentially perpendicular relation to the mounting arm assembly 268 to dispose the fingers 275 to enter the nip area between the replacement core 216 and the winding roller 228 as the arm assembly 268 continues counterclockwise rotation, whereby the fingers 275 mechanically insert and tuck the leading edge of the sheet material M into such nip area, as depicted in FIG. 12. To avoid any unintended and undesired displacement of the replacement core 216 from resting disposition between the winding rollers 228, 230, the microprocessor immediately re-extends the piston-and-cylinder assembly 273 to pivot the mounting arm 271 reversely away from the nip area between the replacement core 216 and the winding roller 228 so that the fingers 275 do not contact the replacement core 216 as the shaft 270 and the arm assembly 268 continue their rotational movement. In order to maximize the efficiency of the winding apparatus 210, it is desirable that traveling delivery of the incoming sheet material M continue uninterrupted during the aforedescribed operation in discharging the fully-wound core 216. For this purpose, the drive to the rotating shaft 270 is controlled to maintain the arcuate traveling speed of the discharge roller 269 at substantially the same speed as the delivery speed of the incoming sheet material M. In this manner, the occurrence of wrinkles and creases in the material, especially sensitive fabrics, is minimized and essentially no down time is experienced in the present winding apparatus during discharge of fully-wound cores.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. Apparatus for winding a traveling sheet of continuous-length material onto a supporting core, said apparatus comprising:

(a) a pair of winding rollers rotatably mounted in spaced axially parallel generally horizontally adjacent relation for cooperatively supporting the core peripherally between said winding rollers;

(b) means for rotatably driving at least one of said winding rollers for driving rotation of the core to wind progressively the traveling sheet of material about the core;

(c) a discharge arm assembly mounted above said winding rollers for movement between an inactive position spaced thereabove during winding of the sheet of material onto the core and a discharge position contacting the core to eject it laterally from said winding rollers;

(d) means for receiving and supporting the core at a spacing from said winding rollers upon ejection of the core; and (e) means operable following ejection of the core for shear cutting the sheet of material transversely across its length at a location intermediate said winding rollers and said receiving and supporting means, said shear cutting means including a cutting blade stationarily mounted at a location intermediate said winding rollers and said receiving and supporting means to engage one face of the sheet of material transversely across its length following ejection of the core from said winding rollers and a cutting blade movably supported for movement into and out of shear cutting relation with said stationary blade from the opposite face of the sheet of material;

said discharge arm assembly and said movable cutting blade being affixed together for coordinated movement of said movable cutting blade in following relation to said discharge arm assembly.

2. Apparatus for winding a traveling sheet of continuous-length material onto a supporting core according to claim 1 and characterized further in that said driving means includes means for driving each said winding roller at individually variable speeds for controlling winding compaction of the sheet of material on the core.

3. Apparatus for winding a traveling sheet of continuous-length material onto a supporting core according to claim 2 and characterized further in that said driving means includes first means for driving one said winding roller at a substantially constant peripheral speed substantially the same as the traveling speed of the sheet of material and second means for driving the other said winding roller at a differing peripheral speed.

4. Apparatus for winding a traveling sheet of continuous-length material onto a supporting core according to claim 3 and characterized further in that said second means is arranged for driving the other said winding roller at a gradually varying peripheral speed as the sheet of material is wound on the core to achieve a generally uniform density of windings of the sheet of material on the core.

5. Apparatus for winding a traveling sheet of continuous-length material onto a supporting core according to claim 3 and characterized further in that said second means is arranged for driving the other said winding roller at a substantially constant peripheral speed slightly greater than the peripheral speed of the one said winding roller for winding the sheet of material in densely compacted windings.

6. Apparatus for winding a traveling sheet of continuous-length material onto a supporting core according to claim 2 and characterized further by means for sensing fluctuations in the tension of the sheet of material and associated with said driving means for varying the driven speed of at least one said winding roller in relation to sensed material tension fluctuations.

7. Apparatus for winding a traveling sheet of continuous-length material onto a supporting core according to claim 1 and characterized further by a biasing roller and means for rotatably supporting said biasing roller in peripheral contact with the core at a location generally diametrically opposite said winding rollers when the core is supported therebetween for maintaining the core in peripheral driven engagement with said winding rollers.

8. Apparatus for winding a traveling sheet of continuous-length material onto a supporting core according to claim 7 and characterized further in that said biasing roller supporting means includes means for displacing said biasing roller away from said winding rollers in relation to the progressive winding of the sheet of material on the core.

9. Apparatus for winding a traveling sheet of continuous-length material onto a supporting core according to claim 8 and characterized further in that said biasing roller supporting means includes means for contacting said biasing roller with the core with a variable force of contact for maintaining a substantially constant force of contact of the core with the winding rollers in relation to the progressive winding of the sheet of material on the core.

10. Apparatus for winding a traveling sheet of continuous-length material onto a supporting core according to claim 9 and characterized further by means associated with at least one said winding roller for detecting the weight of the core and the sheet of material wound thereon and associated with said biasing roller supporting means for controlling said displacing means and said variable force contacting means in relation to progressive winding of the sheet of material on the core.

11. Apparatus for winding a traveling sheet of continuous-length material onto a supporting core according to claim 1 and characterized further by means operable following shear cutting of the sheet of material for directing a first stream of air against a leading end of the sheet of material following the location of shear cutting to wrap the leading end about a replacement core supported on the winding rollers and means for directing a second stream of air against the leading end when wrapped about the replacement core to insert the leading end into a nip between the replacement core and one said winding roller.

12. Apparatus for winding a traveling sheet of continuous-length material onto a supporting core according to claim 11 and characterized further in that said means for directing a second stream of air is mounted to said shear-cutting means.

13. Apparatus for winding a traveling sheet of continuous-length material onto a supporting core according to claim 1 and characterized further by means operable following shear cutting of the sheet of material for dispensing an empty replacement core to said winding rollers.

14. Apparatus for winding a traveling sheet of continuous-length material onto a supporting core according to claim 1 and characterized further in that said movable cutting blade is mounted for orbital movement about an axis of rotation for movement through an arcuate cutting path into and out of cutting relation with said stationary cutting blade.

15. Apparatus for winding a traveling sheet of continuous-length material onto a supporting core according to claim 1 and characterized further in that said discharge arm assembly and said movable cutting blade are rotatably movable about a common rotational axis.

16. Apparatus for winding a traveling sheet of continuous-length material onto a supporting core according to claim 1 and characterized further by means for controlling movement of said discharge arm assembly in coordination with the traveling speed of said sheet of material.

17. Apparatus for winding a traveling sheet of continuous-length material onto a supporting core, said apparatus comprising:

(a) a pair of winding rollers rotatably mounted in spaced axially parallel generally horizontally adjacent relation for cooperatively supporting the core peripherally between said winding rollers;

(b) means for rotatably driving at least one of said winding rollers for driving rotation of the core to wind progressively the traveling sheet of material about the core;

(c) a discharge arm assembly mounted above said winding rollers for movement between an inactive position spaced thereabove during winding of the sheet of material onto the core and a discharge position contacting the core to eject it laterally from said winding rollers;

(d) means for receiving and supporting the core at a spacing from said winding rollers upon ejection of the core;

(e) means operable following ejection of the core for shear cutting the sheet of material transversely across its length at a location intermediate said winding rollers and said receiving and supporting means;

said discharge arm assembly and said shear cutting means being affixed together for coordinated movement of said shear cutting means in following relation to said discharge arm assembly;

said receiving and supporting means includes a pair of supporting rollers rotatably mounted in spaced axially parallel relation for cooperatively supporting the core peripherally between the supporting rollers, means for rotatably driving at least one said supporting roller for driving rotation of the core, and means for applying a peripheral wrapping about the core during rotation of said supporting roller for preventing undesired unwinding of the sheet of material from the core.

18. Apparatus for winding a traveling sheet of continuous-length material onto a supporting core, said apparatus comprising:

(a) a pair of winding rollers rotatably mounted in spaced axially parallel generally horizontally adjacent relation for cooperatively supporting the core peripherally between said winding rollers;

(b) means for rotatably driving at least one of said winding rollers for driving rotation of the core to wind progressively the traveling sheet of material about the core;

(c) a discharge arm assembly mounted above said winding rollers for movement between an inactive position spaced thereabove during winding of the sheet of material onto the core and a discharge position contacting the core to eject it laterally from said winding rollers;

(d) means for receiving and supporting the core at a spacing from said winding rollers upon ejection of the core;

(e) means operable following ejection of the core for shear cutting the sheet of material transversely across its length at a location intermediate said winding rollers and said receiving and supporting means;

(f) means operable following shear-cutting of the sheet of material for directing a stream of air against a leading end of the sheet of material following the location of shear-cutting to wrap the leading end about a replacement core supported on the winding rollers and means for engaging the leading end when wrapped about the replacement core to insert the leading end into a nip between the replacement core and one said winding roller, said means for engaging the leading end of the sheet of material being mounted to said shear cutting means; and said discharge arm assembly and said shear cutting means being affixed together for coordinated movement of said shear cutting means in following relation to said discharge arm assembly.

* * * * *